United States Patent [19]

Chazottes

[11] 4,154,209

[45] May 15, 1979

[54] LOADING STIRRUP FOR AN UNDERWATER WEAPON

[76] Inventor: Jean-François Chazottes, Moniteur International de Plongee Sous-Marine Boite Postale 580, Tahiti, French Polynesia

[21] Appl. No.: 755,287

[22] Filed: Dec. 29, 1976

[30] Foreign Application Priority Data

Jan. 6, 1976 [FR] France ..... 76 00175

[51] Int. Cl.[2] ..... F41B 7/00

[52] U.S. Cl. ..... 124/22; 43/6

[58] Field of Search ..... 124/80, 17, 22, 21, 124/35 R, 41 A, 25, 90, 83, 41 R; 43/6

[56] References Cited

U.S. PATENT DOCUMENTS 3,306,278 2/1967 Spatari ..... 124/22

FOREIGN PATENT DOCUMENTS 142092 7/1951 Australia ..... 124/22

*Primary Examiner*—Richard C. Pinkham
*Assistant Examiner*—William R. Browne
*Attorney, Agent, or Firm*—Pollock, Vande Sande & Priddy

[57] ABSTRACT

The invention relates to a stirrup for use in an underwater weapon for firing arrows. The stirrup comprises two generally V-shaped rods that are joined together at their ends. The rods are attached at their ends to resilient cables for being tensioned to fire the arrows. One of the rods is adapted to fit into the nock of an arrow while the other rod is adapted to brace the stirrup to prevent it from breaking as a result of the forces applied thereto upon repeated firing of arrows. The stirrup of the invention permits thin arrows to be fired with a much improved velocity with regard to prior art weapons.

10 Claims, 11 Drawing Figures

LOADING STIRRUP FOR AN UNDERWATER WEAPON

FIELD OF THE INVENTION

The invention relates to a loading stirrup for an underwater weapon, adapted to be secured to the ends of resilient cables for propelling an arrow.

BACKGROUND TO THE INVENTION

Weapons for firing arrows underwater are well known and have been used for many years. Such weapons typically operate on the principle of a crossbow or a sling, and comprise two or more resilient cables attached to a stirrup. The stirrup is pulled rearwardly to tension the cables and is typically held by a trigger. The nock of an arrow is fitted to the stirrup and the arrow is fired by releasing the trigger.

Conventionally-used stirrups comprise a V-shaped stainless steel rod, the tip or apex of which is curved to engage in a nock in the arrow, the end of each arm of the rod being secured to one of the resilient cables.

The most serious disadvantage of conventional stirrups is that they tend to break near the tip after a relatively low number of arrow shots, as a result of repeated bending stresses to which they are subjected. The arms of the stirrup are subjected to forces pulling the arms together when the weapon is loaded, since the cables are then under high tension and exert considerable tensile force parallel to the longitudinal axis of the arrow. Also, the arms are subjected to forces pulling them apart, during loading, when a hunter pulls on the cables near their attachment to the stirrup, so as to tension the cables.

To prevent breaking of the stirrup, it has been proposed to increase the strength of the stirrup arms by increasing their cross-section, but this requires deeper nocks to be formed on the arrows, which prevents the use of thin arrows, which are most efficient in view of the frictional resistance offered to the arrows in flight underwater.

To obviate these disadvantages, I have proposed in my French Patent Application No. 73 04 632 filed on Feb. 9, 1973, to use a stirrup reinforced by a cross bar which is secured to the V arms at its ends, thus giving a practically undeformable A-shaped assembly. This considerably increases the service life of the stirrup.

A stirrup of this kind, however, is unsuitable for certain kinds of weapons, inter alia weapons comprising several, for example two or three, pairs of cables and an equal number of stirrups engaging in a corresponding number of spaced-out nocks on the arrow.

Furthermore, the reinforcing crossbar may cause trouble for some hunters who, during loading, use the arrow as a guide for the stirrup. For this purpose, the cables are stretched while sliding the stirrup over the arrow until it meets the nock. When an A-shaped stirrup is used, the crossbar, rather than the tip or apex of the stirrup, is engaged with the arrow nock.

SUMMARY OF THE INVENTION

It is an object of the present invention to provide an improved stirrup for use with an underwater weapon of the kind hereinbefore described, but which is less liable to break after repeated use.

It is another object of the invention to provide a stirrup that will permit the firing of relatively thin arrows by means of thick resilient cables.

It is yet another object of the invention to provide a stirrup for an underwater weapon which permits the fire power and reliability of the weapon to be maximized.

To accomplish these objects, the present invention provides a stirrup for attachment to resilient cables of a weapon for use underwater, the stirrup being made of a rigid material such as stainless steel, in a V-shape, and having a curved tip or apex for insertion in the nock of an arrow, the free ends of the stirrup having means whereby each can be secured to the end of a resilient cable used for propelling the arrow, and wherein the stirrup comprises two juxtaposed rods secured to one another near each end.

With a stirrup in accordance with the invention, the cross-section of the rod to which the arrow is attached, in use, can be arranged to be much smaller than the total cross-sectional area of the stirrup, and as a result the stirrup can be used to fire relatively thin arrows having small necks, while using thick resilient cables. In this way, the fire power of the weapon is increased over prior art arrangements, since the firing velocity imparted to the arrows increases with the cable thickness and the range of flight of the arrows is improved by reducing the thickness of the arrows. Moreover, the stirrup of the invention will not tend to break upon repeated use since the other of the V-shaped rods which is not for engagement with the arrows acts as a brace for the arrow receiving rod, thereby providing a particularly strong stirrup which will be reliable and less prone to breaking.

Advantageously, the tip of one rod is offset outside the center plane of the stirrup, so as to leave a free space between the two rods near the tip, for easier fitting of the arrow. A free space between the tips can also be obtained by offsetting each tip on one side of the center plane of the stirrup. Such an arrangement is much faster to load than conventional stirrups.

The total cross-section of the stirrup is chosen so that it is always stressed below its elastic limit, so that the critical cold-drawing angle is never reached and the stirrup, when at rest, returns to the original angle given thereto during manufacture.

In one embodiment of a stirrup of the invention, the two rods are superposed, the bottom rod being adapted for fitting into the nock and the top rod being for reinforcement. In such an arrangement, if one rod has an offset tip, the stirrup can be fitted on the arrow either by means of the rod having an offset tip, if ease of loading is the prime consideration, or by means of the non-offset rod, if preference is given to efficient drawing of the arrow in the plane formed by the stirrup and the stretched cables.

When the stirrup is adapted for loading highpower underwater guns, necessitating the use of two relatively thick rods, the rounded tip of the bottom rod for fitting on to an arrow has a flat portion so that, even in this case, small nocks and thin arrows can be used. The flat portion is guided along the direction of the nock by being slightly inclined with respect to the center plane of the stirrup, the inclination being towards the front of the stirrup.

In another embodiment, the two rods are juxtaposed in the same plane, the outer rod forming the reinforcement and the inner rod being used for loading. In that case the tip of the inner rod is offset so that it alone fits into the nock.

BRIEF DESCRIPTION OF THE DRAWINGS

Features, objects and advantages of the invention will become apparent from the following description of a number of preferred embodiments thereof given by way of illustrative example only, with reference to the accompanying drawings, in which.

DESCRIPTION OF PREFERRED EMBODIMENTS

Several different embodiments of stirrups in accordance with the invention will now be described. Their attachment to the resilient propulsion cables of an underwater weapon and their attachment to the notch of an arrow is also described in detail. However, for simplicity and ease of understanding of the present invention, specific constructional details of the underwater weapon have been omitted since they are well known in the art and will be readily apparent to those skilled workers conversant with underwater weapon technology and allied arts.

Figure 1:
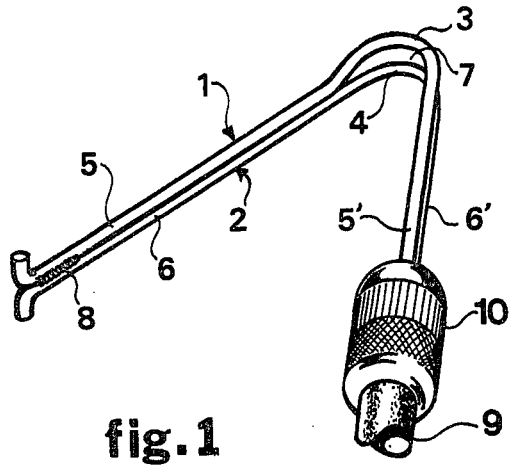
FIG. 1 is a perspective view of a stirrup according to the invention adapted for attachment to the resilient propulsion cables of an underwater weapon.

FIG. 1 shows a stirrup made of two stainless steel rods 1, 2 having a circular cross-section, substantially equal in length and bent into a V so that each has a rounded apex or tip 3, 4 respectively between two arms 5, 5' and 6, 6' respectively. The ends of the rods are welded together. The rounded tip 3 of rod 1 is offset with respect to a plane in which the arms 5 and 5' lie.

The rods 1 and 2 are disposed with respect to one another so that their corresponding arms 5, 6 and 5', 6' respectively are contiguous and arranged one above the other in a direction transversely of said plane, but a free space 7 is left between the offset tip 3 of rod 1 and the non-offset tip 4 of rod 2. Arms 5, 6 and 5', 6' respectively are secured together near their free end by a weld bead 8.

The stirrup is secured, at each of its welded ends, to the end of a resilient propulsion cable 9 by means of a cap 10 made up of two screwed-together parts, one part fitting on to the stirrup arm and the other part gripping the end of the cable.

Figure 1A:
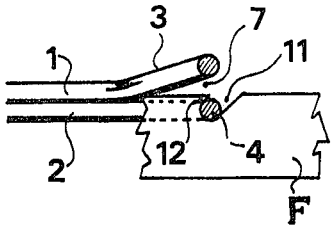
FIG. 1*a* is a detailed view in longitudinal section of the stirrup of FIG. 1, in its loaded position on an arrow.

As shown in FIG. 1*a*, the rounded tip 4 of the bottom rod 2, when in the loading position, fits into a nock 11 on an arrow F, the tip 12 of the nock resting between tips 3 and 4 and in the free space 7. In the stirrup shown, rods 1 and 2 have the same cross section and thus, if the stirrup is installed the other way up, the arrow can be loaded on the offset tip of rod 1.

Figure 2:
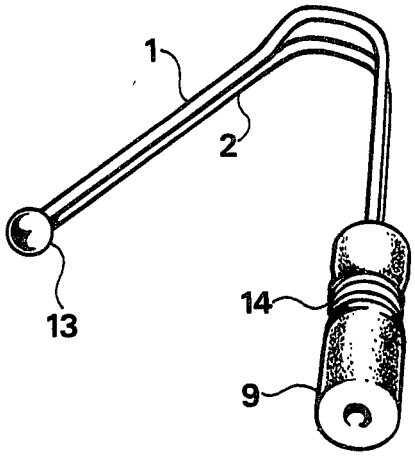
FIG. 2 is a perspective view of a stirrup of the kind shown in FIG. 1, adapted to another method of securing, FIGS. 3 and 4 and perspective views of two embodiments of a stirrup of the general kind shown in FIGS. 1 and 2, FIGS. 3*a* and 4*a* are detailed views in longitudinal section and in the loading position of the stirrups shown in FIGS. 3 and 4 respectively.

FIG. 2 illustrates a stirrup of the same kind as that shown in FIG. 1, but in which each end of the arms is in the form of a ball 13 for fitting into a hollow core of the resilient cables 9, the cables each being secured to a respective stirrup arm by a splice 14.

Figure 3:
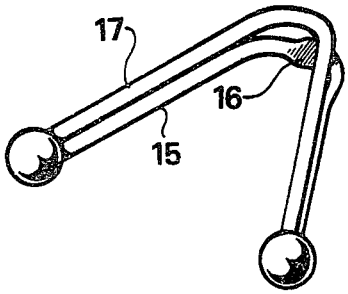
Figure 3A:
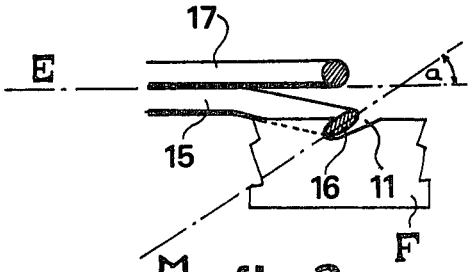

In FIGS. 3 and 3*a*, there is shown a stirrup for use in high powered underwater weapons. The stirrup is similar to that shown in FIG. 2 and comprises two V-shaped rods 15 and 17, which are thicker than the rods 1, 2. The tip of the bottom or loading rod 15 is constructed so as to engage in an arrow nock too small to hold the circular section. To this end, the tip of rod 15 has a flattened portion 16 of elliptical transverse section whose major axis cuts the center plane E of the stirrup at an angle a substantially equal to the angle of inclination of nock 11 on the arrow F.

The flattened portion somewhat weakens the bending strength of the rod on which it is formed. To compensate for this weakness, the top or reinforcing rod 17 is arranged to retain its original cross-section at its tip so that the stirrup has sufficient strength not to be damaged by repeated bending stresses occurring during successive loading operations.

Figure 4:
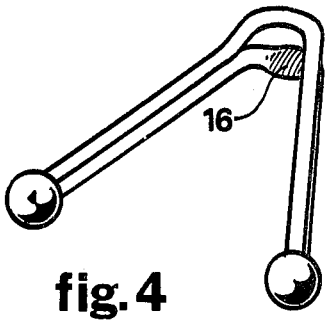
Figure 4A:
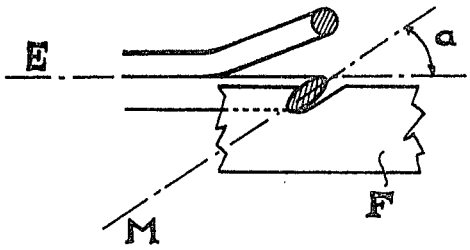

Flattened portion 16 can be formed either on the rod having the offset tip as shown in FIGS. 3 and 3*a* or on the non-offset tip, as shown in FIGS. 4 and 4*a*.

Figure 5:
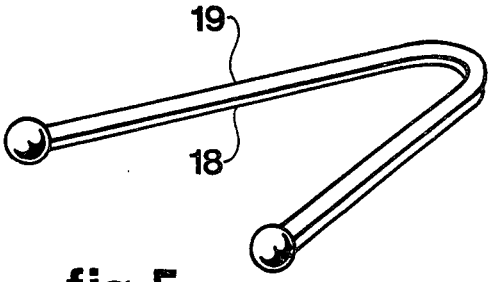
FIGS. 5 and 6 are perspective views of two other kinds of stirrups according to the invention.
Figure 5A:
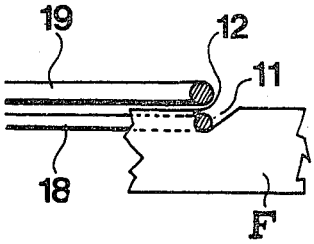
FIGS. 5*a* and 6*a* are detailed views in longitudinal section of the stirrups in FIGS. 5 and 6 in their loading position.

In FIGS. 5, 5*a* there is illustrated an embodiment of a stirrup comprising superposed rods in which two rods 18, 19 have different cross-sections and are juxtaposed over their entire lengths including the tip, neither rod being offset from the center plane of the stirrup. During loading, the tip 12 of the nock fits between the rods and moves them apart. The thinner rod 18 engages in nock 11 whereas the reinforcing rod 19 is held on tip 12. When at rest, the two rods return into contact with one another, owing to the resilience of the metal of which they are formed. A stirrup of this kind has a hydrodynamic advantage owing to its lower resistance to motion in water.

While the stirrup of FIGS. 5 and 5*a* has been described as having different thickness rods and is shown as having spherical ends for attachment to the propulsion cables 9, the stirrup could be made of the same diameter rods and be adapted to receive end caps of the kind described with reference to FIG. 1. Alternatively, the ends of the rods can be provided with removable balls to permit the cables to be attached by means of the balls or by means of end caps, as desired by the hunter.

Figure 6:
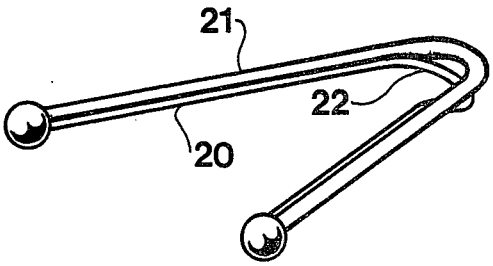
Figure 6A:
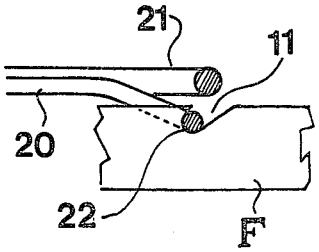

FIGS. 6, 6*a* show another embodiment of stirrup according to the invention, wherein the two constituent rods are arranged so that all of their arms lie in the same plane.

In a stirrup of this kind, a rod 20 is disposed within the V of the other rod 21 and is used for loading. The rod 20 has an offset tip 22 so as to fit into nock 11 of arrow F. When, as shown in FIGS. 6 and 6*a*, the two rods have different cross-sections, the outer or reinforcing rod 21 is the thicker of the rods.

Depending on the kind of weapon for which they are intended, stirrups in accordance with the invention can have arms of varying lengths made of rods of varying thickness. Usually the arm lengths are within a range of about 40 to 70 millimeters and the stainless steel wires used have a diameter of the order of 2 to 3 millimeters, but in some very special cases stirrups can have arm lengths and rod thickness departing from the limits given.

The stirrups are usually made of thick steel wire so as to be very rigid and so that there is no risk of the arm ends being deflected too close to one another when the cables are stretched. The stirrups have the advantage that they can be made shorter than those conventionally used, thus leaving a greater length on the weapon for the resilient cables, thus increasing the power of the weapon.

Stirrups with an offset tip are particularly suitable for loading weapons having a number of pairs of resilient propulsion cables and a similar number of stirrups, each associated with a pair of cables for fitting into respective spaced-apart nocks on the arrow, since, firstly the offset tip facilitates engagement of the nock when the hunter, after fitting the first stirrup in the most forward nock in the arrow, has to stretch the cables associated with the second stirrup and move it above the already-positioned stirrup to reach the second nock. Secondly, the stirrup can be made compact, its bulk being reduced to a minimum by using the ball and splice securing system (less bulky than the cap), thus reducing the distance between nocks on the arrow and increasing the efficiency of the weapon, for a given number of cables, by moving back the nocks as far as possible along the arrow to increase cable tension, or increasing the power of the weapon by permitting an additional nock to be formed on the arrow so that an extra pair of propulsion cables can be used.

Without departing from the invention, the stirrup can be strengthened by a crossbar, i.e., an A-type stirrup described in my French Patent Application aforementioned.

Likewise the reinforcing and loading rods can occupy any suitable position relative to one another, between the position where their center lines are vertically above one another (superposed rods) and the position where all of the arms of the rods lie in the same plane.

Also, the two rods can be secured at their ends such that the arms are disposed at a small angle to one another so as to leave sufficient free loading space between their tips without one tip being offset.

I claim:

1. A stirrup for an arrow-propelling weapon, said stirrup being of a generally U-shaped configuration and comprising (a) means for supporting all the traction forces in said stirrup, comprising a first length of rod bent into a generally V-shaped configuration to define therein first and second arms having therebetween a first tip portion;

(b) means for increasing the rigidity during flexure of said first length of rod, comprising a second length of rod bent into a generally V-shaped configuration to define therein first and second arms having therebetween a second tip portion;

(c) means for joining together in a rigid joint said first arms and said second arms, respectively, at the ends thereof; and (d) means for engaging said first tip portion only with the nock of an arrow to be propelled, said second tip portion remaining free of such engagement;

(e) said arms of said first and second lengths of rod lying in respective common planes substantially parallel to one another.

2. A stirrup according to claim 1, wherein said first tip portion diverges from said common plane of said first length of rod in the direction away from said second length of rod, whereby to facilitate the engagement of said first tip portion with said nock of said arrow while avoiding engagement of said second tip portion with said nock.

3. A stirrup according to claim 1, wherein both said first and second lengths of rod are generally rigid but resiliently deformable.

4. A stirrup according to claim 1, wherein all of said first and second arms of said first and second lengths of rod lie in the same plane.

5. A stirrup according to claim 4, wherein said second tip portion driverges from said same plane of said first and second lengths of rod.

6. A stirrup according to claim 4, wherein said first length of rod is disposed within the V-shape of said second length of rod.

7. A stirrup according to claim 1, wherein said first and second lengths of rod have the same cross-sectional area.

8. A stirrup according to claim 1, wherein said first and second lengths of rod have different cross-sectional areas.

9. A stirrup according to claim 1, wherein said first tip portion has an elliptical cross-section to facilitate its engagement with said nock of said arrow.

10. In a weapon adapted for use underwater to fire arrows, comprising at least two resilient propulsion cables, a generally V-shaped stirrup adapted to engage a nock on an arrow, and means attaching said cables to said stirrup, whereby upon said cables being placed under tension and upon the nock of said arrow being engaged with said stirrup and upon release of said tension, said arrow is propelled by virtue of the tension forces in said cables, the improvement comprising a stirrup construction including:

(a) means for supporting all the traction forces in said stirrup, comprising a first length of rod bent into a generally V-shaped configuration to define therein first and second arms having therebetween a first tip portion;

(b) means for increasing the rigidity during flexure of said first length of rod, comprising a second length of rod bent into a generally V-shaped configuration to define therein first and second arms having therebetween a second tip portion;

(c) means for joining together in a rigid joint said first arms and said second arms, respectively, at the ends thereof; and (d) means for engaging said first tip portion only with the nock of an arrow to be propelled, said second tip portion remaining free of such engagement;

(e) said arms of said first and second lengths of rod lying in respective common planes substantially parallel to one another.

* * * * *